US005242141A

United States Patent [19]

Chester

[11] Patent Number: 5,242,141

[45] Date of Patent: Sep. 7, 1993

[54] FURNITURE LEG

[75] Inventor: Brian Chester, New South Wales, Australia

[73] Assignee: Trychest Pty. Limited, Sydney, Australia

[21] Appl. No.: 972,768

[22] Filed: Nov. 5, 1992

[51] Int. Cl.[5] ..... A47B 91/00

[52] U.S. Cl. ..... 248/188.9

[58] Field of Search ..... 248/188.8, 188.9, 188.2; 135/84

[56] References Cited

U.S. PATENT DOCUMENTS

| | | | |
|---|---|---|---|
| 19,924 | 7/1895 | McLaughlin | 248/188.9 |
| 416,030 | 11/1889 | Clapp | 312/332 |
| 430,908 | 6/1890 | Williams | 312/332 |
| 765,984 | 7/1904 | Morris et al. | 135/84 |
| 780,684 | 1/1905 | Pratt | 248/188.9 |
| 994,194 | 6/1911 | Pratt | 135/84 |
| 1,852,751 | 4/1932 | Johnson | 248/188.9 |
| 2,262,063 | 11/1941 | Swarr | 248/188.9 |
| 2,666,608 | 1/1954 | Holm | 248/188.8 |
| 2,728,166 | 12/1955 | Molla | 248/188.9 |
| 2,890,544 | 6/1959 | Manausa | 2118/188.9 |
| 2,992,509 | 7/1961 | Gaenzle | 248/188.9 |
| 3,006,673 | 10/1961 | Swick | 248/188.8 |
| 4,940,203 | 7/1990 | Hayakawa | 248/188.9 |

FOREIGN PATENT DOCUMENTS

| | | | |
|---|---|---|---|
| 541293 | 1/1951 | Canada | 248/188.8 |
| 653033 | 10/1937 | Fed. Rep. of Germany | 248/188.8 |
| 540669 | 4/1922 | France | 248/188.8 |
| 1202042 | 4/1959 | France | 248/188.8 |
| 908325 | 10/1962 | United Kingdom | 248/188.9 |

*Primary Examiner*—Ramon O. Ramirez
*Assistant Examiner*—Korie H. Chan
*Attorney, Agent, or Firm*—Smith-Hill & Bedell

[57] ABSTRACT

A furniture leg is provided with means for compensating for uneven floor levels. Such means take the form of a rocker (17″) protruding from a cavity in the lower end of the leg. Leaf springs (4″) bias the rocker downwardly to a mid-position. Arched pistons (25″) on the rocker (17″) extend into arched chambers (22″) in the leg which intercommunicate with one another through a throttle (23″). The axis of the arched pistons and chambers and closely fitting curved surfaces (5″, 6″) of the rocker and leg are all centered on the axis about which rocking occurs and which is provided by the engagement of the upper surface of the rocker with a ridge (19″) on the socket roof.

5 Claims, 3 Drawing Sheets

FURNITURE LEG

FIELD OF THE INVENTION

This invention relates to a furniture leg and is more specifically concerned with providing the leg with an arrangement which compensates, at least partially, for height irregularities in the surface profile of the floor on which the leg is resting.

SUMMARY OF THE INVENTION

In accordance with the present invention an arrangement for fitting to the lower end of a leg of furniture, provides a socket containing a rocker which protrudes downwardly from the socket to provide an elongated foot on which the leg rests, the rocker being turnable against a yielding resistance to allow the foot to tilt from a rest position at which the foot is horizontal, to an inclined position at which one end of the foot is higher or lower than its other end to compensate, at least partially, for any small irregularity in the surface of a floor on which the foot is resting.

The surface irregularity may comprise a slight difference in height of neighbouring edges of two floor tiles, or an edge of a carpet on which the foot is resting. The yielding resistance may be provided pneumatically, hydraulically, or by a resiliently flexible member such as a spring.

PREFERRED FEATURES OF THE INVENTION

Conveniently the rocker is mounted in the socket in a way which allows it to displace vertically as well as to rock. The leg is then able to compensate for small changes in height of the floor beneath respective legs, as well as for imperfections in the surface profile of the floor area on which the leg is resting.

One way of carrying out the invention is to have the rocker integrally formed with a leaf spring which bears at its ends on respective parts of a roof of the socket and has its central portion spaced a small distance beneath the roof. The leaf spring extends in the same plane as the foot so that if the surface of the floor area beneath it is higher at the "toe" as compared with the "heel" of the foot, the leaf-spring flexes to allow the rocker to turn and permit the foot to tilt to compensate partially for the height difference.

If the floor surface beneath one of the legs is higher than beneath the other legs, the foot of the higher leg remains horizontal and the leaf spring flexes to foreshorten the leg slightly. This occurs automatically as the longer leg will have a greater portion of the load resting on it than the other legs.

INTRODUCTION TO THE DRAWINGS

The invention will now be described in more detail, by way of examples, with reference to the accompanying informal drawings, in which:

In the Drawings

Figure 6:
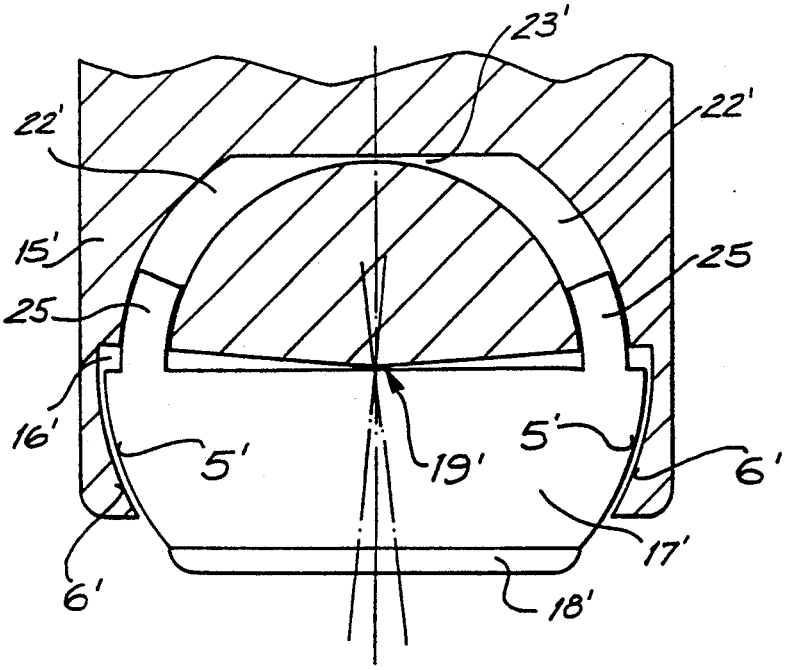
Figure 7:
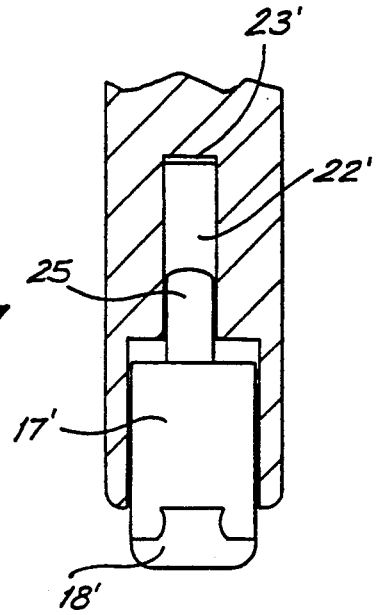
Figure 8:
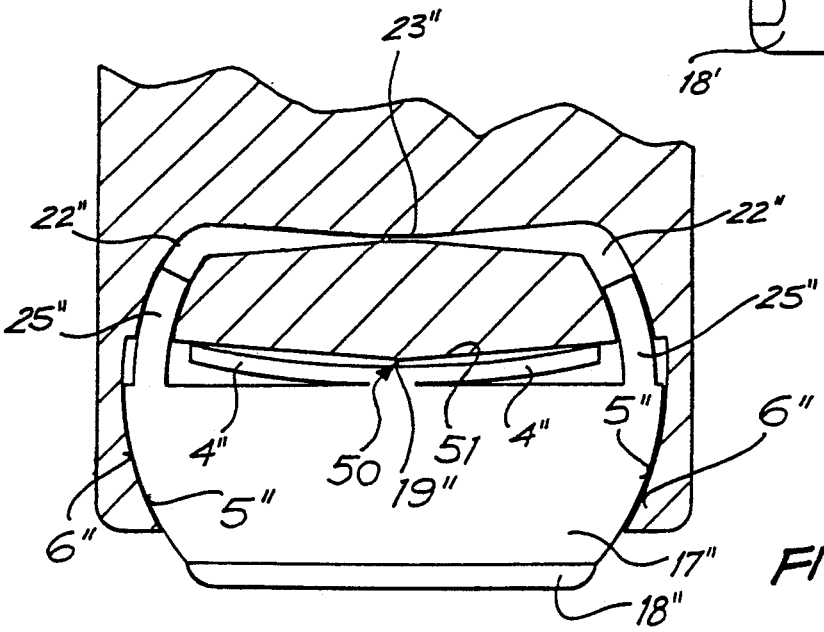

FIGS. 6 and 7 respectively show, in sectional side and end elevations, a third embodiment of rocker; and, FIG. 8 shows a fourth embodiment of rocker which combines the advantages of the earlier-described rockers.

DESCRIPTION OF THE FIRST EMBODIMENT

Figure 1:
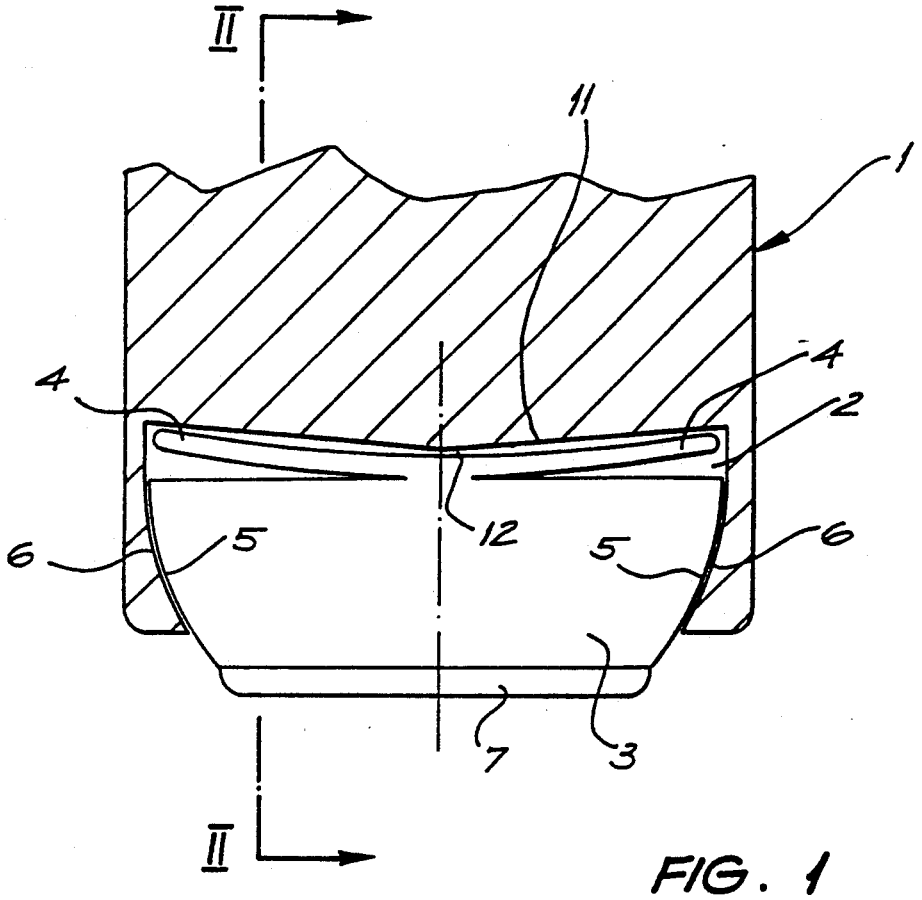
FIG. 1 is a vertical section through a lower end-portion of a table leg as viewed from one side and showing a first embodiment of rocker.
Figure 2:
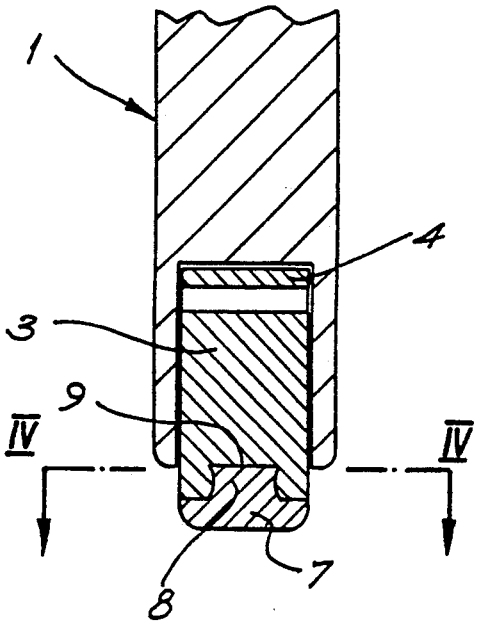
FIG. 2 is a vertical section through FIG. 1 taken on the line and in the direction indicated by the arrows II—II in FIG. 1.

FIGS. 1 and 2 show the lower end-portion 1 of a table leg of elongated oblong cross-section. A socket 2 is formed in the underside of the end-portion which is made up from two half-leg mouldings of plastics material secured together face-to-face. The socket 2 opens downwardly through the underface of the end-portion of the leg.

The socket 2 contains an elongated, flat-sided rocker block 3 integrally formed in its upper surface with a leaf spring 4. The rocker block 3 is a snug sliding fit in the socket 2 during rocking, and has convex end faces 5 which extend very close to complementary concave end walls 6 of the socket 2 so that the rocker can rock without actually displacing horizontally. The centre of the leaf spring 4 is united with the centre of the upper surface of the block 3—the two being formed as a unitary structure from the same resilient and hard plastics material such as nylon—the material of the block 3 having self-lubricating properties with respect to the material of the end-portion 1 so that the curved contiguous surfaces 5 and 6 can slide smoothly over one another during rocking.

Figure 4:
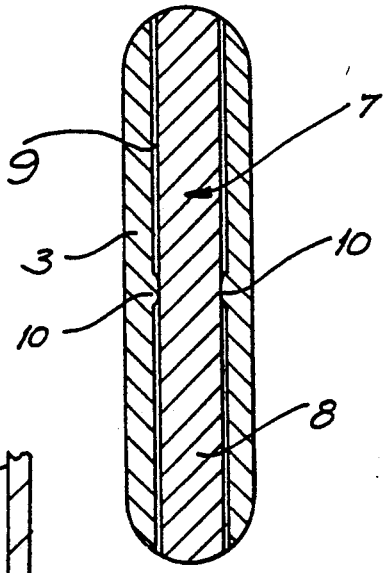
FIG. 4 is a cross-section through a rocker taken on the line and in the direction indicated by the arrows IV—IV in FIG. 2.

The underside of the rocker block 3 is provided with an elongated foot 7 shown in FIG. 2 and which lies in the same vertical plane as the spring 4. The foot 7 is moulded separately from the block 1 and is provided with a wedge-shaped upper formation 8 shown in FIG. 2. The underside of the block 3 is formed with an elongated channel 9 provided with opposed beads 10 in its centre as shown in FIG. 4. These beads 10 fit into dimples in the centres of the side of the formation 8 to locate the foot 7 positively with respect to the channel 9 of the block 3. The underside of the block 3 protrudes downwardly from the socket 2 as shown in FIGS. 1 and 2.

The rocker block 3 rocks about a ridge 60 formed in the centre of the underside of the roof 11 of the socket 2, and the arcuate curvature of the surfaces 5 and 6 is centred on the ridge.

OPERATION OF THE PREFERRED EMBODIMENT

Figure 3:
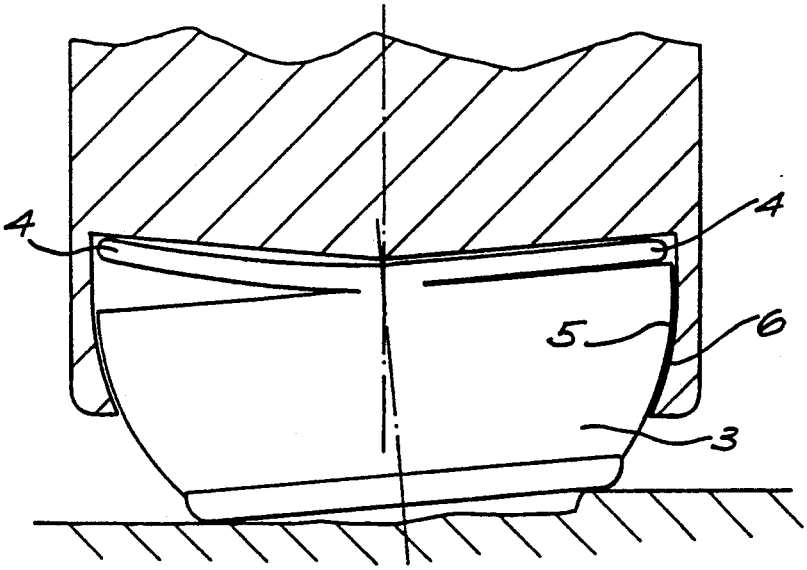
FIG. 3 shows the leg end-portion compensating partially for differences in the height of the floor on which it rests.

The rocker block 3 is resiliently held in the position shown in FIGS. 1 and 2 by the leaf spring 4 which engages opposite ends of the roof 11 of the socket 12, as shown in FIG. 1. A small gap 12 exists between the central portion of the top face of the block 3 and the ridge 60 of the roof 11 so that the block 3 is permitted to displace bodily upwards in the socket 2 through a small distance, against the resilience of the leaf spring 4. The rocking movement of the block 3 allows the foot 7 to tilt downwardly either towards its 'toe' (as shown in FIG. 3), or conversely towards its 'heel', if the foot rests on surfaces one of which is higher than the other. This tilting movement is permitted by resilient flexing of one leaf of the leaf spring 4 disposed above the higher end of the foot.

The block 3 is located in its working position in the socket 2 during assembly of the two halves of the leg end-portion, before they are actually bonded together.

The arrangement shown in FIGS. 1 to 4 may be constructed as a separate attachment for fitting into an upright bore in the underside of a leg of a piece of furniture, or it may be built integrally into the furniture leg as has been described. The advantage of the former case is that the separate attachment can be made and sold separately from the furniture with which it is to be used.

DESCRIPTION OF SECOND EMBODIMENT

Figure 5:
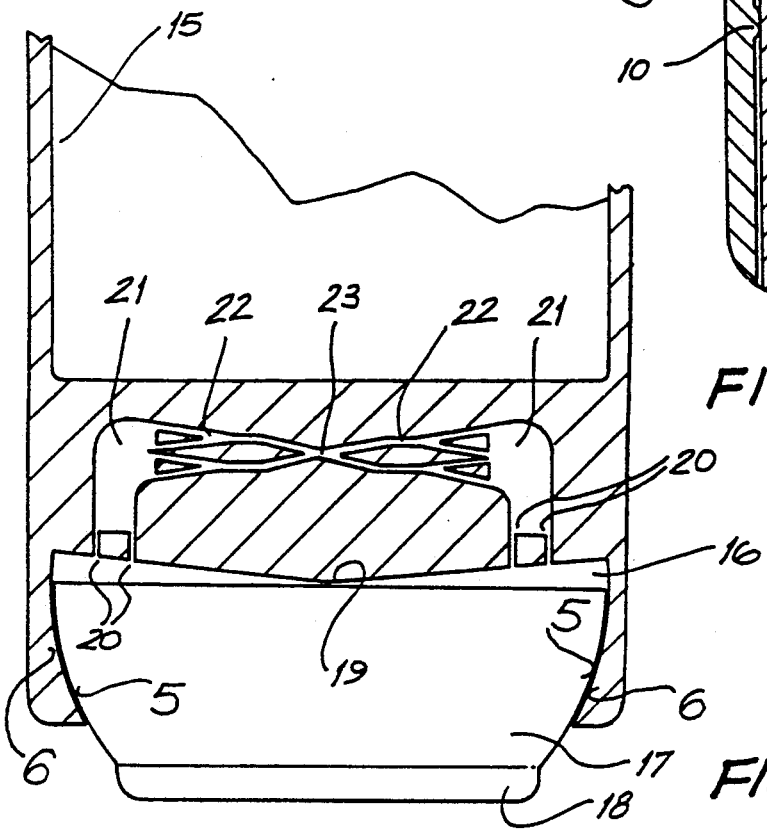
FIG. 5 illustrates the use of pneumatic air damping to control the rate of movement of a second embodiment of rocker, between two operating positions, the horizontal shape of the rocker in cross-section being similar to that shown in FIG. 4.

FIG. 5 is a vertical section through a lower portion 15 of a leg of a table. The lower portion is once again made from two half portions made of plastics material fitted together face-to-face and then bonded to one another. FIG. 5 actually shows the face of one half portion of the leg, the face abutting an identical half face of the other half portion of the leg. Both half portions are made in the same mould to provide a finished leg of oblong horizontal cross-section having a rocker block 17 fitting into a socket 16 in the underside, as shown. The underside of the block 17 protrudes from the underside of the socket 16 and is formed with a foot 18 which is assembled identically to the foot 7 described above with reference to FIGS. 1 and 4. The only difference between the block 17 and the block 3 described in the previous embodiment, is the absence of the leaf spring 4. The centre of the top of the block 17 fits close to a ridge 19 in the centre of the roof of the socket 16, the roof being of a chevron-shaped profile as shown. The block and its accommodating socket have arcuate side walls 5 and 6 which are centred on the ridge 19.

The roof of the socket 16 is provided towards opposite end-portions with two pairs of bores 20 spaced above opposite end-portions of the block 17. These bores 20 lead upwardly into two air chambers 21 from which further bores 22 lead into opposite ends of a narrow throttling orifice 23. Thus the two chambers 21 intercommunicate with one another by way of the air throttling orifice 23.

OPERATION OF SECOND EMBODIMENT

In use of the arrangement of FIG. 5, the curved sides of the rocker block 17 are a very close sliding fit against complementary curved sides of the socket 16 and each is arcuate about the ridge 19. If the leg 15 is placed on an uneven surface, causing the foot 18 to tilt 'toe-up' (or conversely 'heel-up'), such tilting will occur relatively slowly as it is opposed by the air compressed in whichever of the chambers 21 is above the higher portion of the surface beneath the foot. The weight of the table supported by the foot forces air gradually through the orifice 23 between the two chambers 21 so as to equalise the pressure difference between them. This is accompanied by gradual rocking of the block 17 and thus tilting of the foot 18.

The advantage of the arrangements shown in FIG. 5 is that the feet of the table automatically adjust themselves to compensate partially for small differences in the height of the floor on which the feet rest.

DESCRIPTION OF THIRD EMBODIMENT

The arrangement shown in FIGS. 6 and 7 is similar in construction and operation to that shown in FIG. 5, and similar parts are similarly referenced but with primed references. These parts will not therefore be again described, for the sake of brevity.

In FIGS. 6 and 7 a rocker block 17' is provided in its upper surface with a pair of horn-like arcuate pistons 25 which are each a sealing sliding fit inside a complementary arched air chamber 22' which is arcuate about the centre of rocking of the block 17' and defined by the ridge 19'. Curved sides 6 of the rocker block 17' in this arrangement do not have to be a close sliding fit against curved walls 5 of the socket 26' for the arrangement to operate, as the socket 16' containing the rocker block 17' does not play any part in controlling the rate of tilt of the block. Rocking of the block 17' about the ridge 19 causes one or other of the chambers 22' to have the air within it compressed by one of the pistons 25, and simultaneously the air pressure in the other chamber is reduced by the movement of its piston. Air is forced by these pressure changes, through a throttling orifice 23', at a relatively slow rate. This provides a damping movement of the rocker block 17' as it tilts to a new position determined by the unevenness of the floor surface beneath it.

DESCRIPTION OF FOURTH EMBODIMENT

Turning now to the arrangement of FIG. 8, its parts corresponding in construction and function to similar (but not identical) parts of the arrangements already described, are similarly referenced but with double priming. In order to save unnecessary repetition of description, these parts will not be again described.

In the arrangement of FIG. 8, a double-ended leaf spring 4'' is used to provide a bias which resiliently resists tilting of a rocker block 17''. The leaf spring 4'' also allows the block 17'' to displace a small amount vertically as there is a small gap 50 between the centre of the block 17'' and the ridge 19'' formed in the centre of the underside of the chevron-shaped roof 51 to the socket 16''. The slow movement of the air through a throttling orifice 23'' between two chambers 22'' ensures that tilting movement of the rocker block 17'' occurs gradually. The pistons 25'' have their external cylindrical walls provided with soft rubber sealing rings which seal against the walls of the chambers 22'' in which the pistons move, but yield resiliently, without impairing their sealing effect, to allow vertical displacement of the block 17'' through the small distance permitted by the gap 50. The opposed curved surfaces 5'', 6'' of the socket 16'' and the block 17'', and curviture of the axes of the pistons 25'' and the chambers 22'', are all centred on the ridge 19'' of the socket roof which provides the axis about which the body 17'' rocks. The leaf spring 4'' extend in the same vertical plane as the foot 18''.

In all of the above embodiments of the invention, the foot is preferably mounted in the block so that it can be knocked out endwise and replaced with a new one, if it gets damaged or worn through prolonged usage. The use of the interfitting formation 8 in the channel 9, and the use of the positive location of the foot provided by the engagement of the beads 10 in the dimples (described previously) enable this to occur.

I claim:

1. A furniture leg, a lower end-portion to said leg, a downwardly opening socket in the underside of said lower end-portion, a rocker mounted on the socket and protruding from its underside, a foot provided on the protruding underside of said rocker, opposed arcuately-convex surfaces provided on one pair of opposite sides of said socket inside said socket, arcuately-concave surfaces defining opposite sides of said socket and disposed respectively adjacent and parallel said rocker convex surfaces, first means disposed between said rocker and said socket and defining a pivotal axis external of said rocker about which said rocker can rock in said socket and second means which are disposed within the socket and yield resiliently to bodily upward displacement of said rocker, said concave and convex surfaces being substantially centered on said pivotal axis.

2. A furniture leg as set forth in claim 1, including third means operating pneumatically by passage of air through a throttling orifice communicating between two chambers which have their volumes varied inversely with tilting of the rocker.

3. A furniture leg as set forth in claim 2, in which said rocker is integrally formed with resilient leaf spring means engaging a roof portion of the socket and urging the rocker towards a position at which the foot is horizontal, the leaf spring and foot lying in the same vertical plane.

4. A furniture leg as set forth in claim 1, in which the pivotal axis about which the rocker tilts is defined between the upper portion of the rocker and a ridge formed on a roof portion of the socket.

5. A furniture leg, a lower end portion to said leg, a downwardly opening socket in the underside of said lower end-portion, a ridge formed on a roof portion of the socket and defining a pivotal axis, a rocker mounted in said socket and protruding from its underside, a foot provided on the protruding underside of said rocker, opposed arcuately-convex surfaces provided on one pair of opposite sides of said rocker inside said socket, arcuately-concave surfaces defining opposite sides of said socket and disposed respectively adjacent and parallel said rocker convex surfaces, said concave and convex surfaces being substantially centered on said pivotal axis, said rocker being able to rock in said socket about said pivotal axis, a leaf spring that spaces the upper portion of the rocker from the ridge and yields to bodily upward displacement of said rocker, and wherein the weight of the furniture on the leg compresses the leaf spring to engage the rocker with the ridge in order to provide the pivotal axis about which tilting of the rocker takes place.

* * * * *